US011904210B2

(12) United States Patent
Madson et al.

(10) Patent No.: US 11,904,210 B2
(45) Date of Patent: Feb. 20, 2024

(54) GOLF BALL DIMPLE PROFILE AND PLAN SHAPE

(71) Applicant: Acushnet Company, Fairhaven, MA (US)

(72) Inventors: Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/192,284

(22) Filed: Mar. 29, 2023

(65) Prior Publication Data

US 2023/0226414 A1 Jul. 20, 2023

Related U.S. Application Data

(63) Continuation of application No. 17/538,060, filed on Nov. 30, 2021, now Pat. No. 11,617,923.

(51) Int. Cl.
*A63B 37/06* (2006.01)
*A63B 37/00* (2006.01)

(52) U.S. Cl.
CPC ..... *A63B 37/0012* (2013.01); *A63B 37/0009* (2013.01)

(58) Field of Classification Search
CPC ..... A63B 37/0004; A63B 37/0007
See application file for complete search history.

(56) References Cited

U.S. PATENT DOCUMENTS 6,905,426 B2 6/2005 Morgan et al.

*Primary Examiner* — Raeann Gorden
(74) *Attorney, Agent, or Firm* — Steven Landolfi, Jr.

(57) ABSTRACT

Golf ball having a generally spherical surface and comprising a plurality of dimples separated by a land area formed on the ball surface, wherein the plurality of dimples includes at least one non-spherical dimple having a non-axially symmetric plan shape and a defined point of maximum dimple depth, wherein: (i) each dimple cross-section of the non-spherical dimple consists of two arcs, each arc extending from the defined point of maximum dimple depth to a point at the land area of the golf ball; and (ii) every point on the perimeter of the non-spherical dimple is located at a radial angle, $\theta$, about a unit circle, where $0 \leq \theta \leq 2\pi$, and the edge angle value of the non-spherical dimple at any given point on the perimeter is defined by the solution of an edge angle function $f(\theta)$, wherein $f(\theta)$ is a non-periodic, continuous, differentiable function.

20 Claims, 12 Drawing Sheets

GOLF BALL DIMPLE PROFILE AND PLAN SHAPE

CROSS-REFERENCE TO RELATED APPLICATIONS

This application is a continuation of U.S. patent application Ser. No. 17/538,060, filed Nov. 30, 2021, which is hereby incorporated herein in its entirety.

FIELD OF THE INVENTION

The field of the invention broadly comprises golf balls incorporating improved non-spherical dimples which can optimize air flow across the dimple in multiple directions, provide added flexibility in dimple count and placement, and meanwhile create a unique aesthetic appearance on the golf ball surface.

BACKGROUND OF THE INVENTION

Golf balls generally include a spherical outer surface with a plurality of dimples formed therein. Dimples improve the aerodynamic characteristics of a golf ball, and therefore, golf ball manufacturers continue to search for unique dimple patterns, shapes, volumes, and cross-sections which can maximize the aerodynamic performance of a golf ball.

Golf ball dimples are often spherical dimples, i.e., dimples having a circular plan shape and a profile based on a spherical function. Unfortunately, the circular perimeters of spherical dimples generally limit dimple count and packing efficiency within the golf ball outer surface. And circular plan-shaped dimples cannot be tessellated or tiled on the surface of a ball with narrow uniform gaps. Even with ideal packing, triangular pieces of land area remain where three dimples come together. Among other things, this can cause inconsistent turning angles of the airflow entering the dimples.

Although golf ball manufacturers have previously explored using non-spherical dimple designs to overcome the limits of spherical dimples, there remains a need to develop uniquely configured non-spherical dimples that can optimize directional air flow across the dimple in multiple directions and meanwhile provide improved flexibility regarding dimple count, placement and visual appearance of the dimples in the finished golf ball. Golf balls of the invention address and fill these needs and yet are desirably producible cost effectively within already existing manufacturing processes without sacrificing the benefits of circular dimples in golf ball constructions.

SUMMARY OF THE INVENTION

Accordingly, in one embodiment, a golf ball of the invention has a generally spherical surface and comprising a plurality of dimples separated by a land area formed on the ball surface, wherein the plurality of dimples includes at least one non-spherical dimple having a non-axially symmetric plan shape and a defined point of maximum dimple depth, wherein: (i) each dimple cross-section of the non-spherical dimple consists of two arcs, each arc extending from the defined point of maximum dimple depth to a point at the land area of the golf ball; and (ii) every point on the perimeter of the non-spherical dimple is located at a radial angle, $\theta$, about a unit circle, where $0 \leq \theta \leq 2\pi$, and the edge angle value of the non-spherical dimple at any given point on the perimeter is defined by the solution of an edge angle function $f(\theta)$, wherein $f(\theta)$ is a non-periodic, continuous, differentiable function.

In one such embodiment, each of said non-spherical dimples has a maximum dimple depth of from about 0.005 inches to about 0.020 inches.

In another such embodiment, each of said non-spherical dimples has an average edge angle of from about 9 degrees to about 19 degrees. In yet another such embodiment, each of said non-spherical dimples has an average edge angle of from about 10 degrees to about 18 degrees. In still another such embodiment, each of said non-spherical dimples has an average edge angle of from about 12.5 degrees to about 15.5 degrees.

In a specific embodiment, each of said non-spherical dimples has a dimple volume $D_v$ such that $V_s1<D_v<V_s2$; wherein $V_s1=0.0300x^2+0.0016x-3.00\times10^{-6}$, and $V_s2=-0.0464x^2+0.0135x-2.00\times10^{-5}$, and x is the dimple's plan shape area.

In one such specific embodiment, x is from about 0.0025 in.$^2$ to about 0.045 in.$^2$. In another such specific embodiment, x is from about 0.0030 in.$^2$ to about 0.040 in.$^2$. In yet another such specific embodiment, x is from about 0.0025 in.$^2$ to about 0.035 in.$^2$. In still another such specific embodiment, x is greater than 0.0035 in.$^2$ and up to about 0.045 in.$^2$.

In one embodiment, the plurality of dimples includes a plurality of said non-spherical dimples, and the plurality of non-spherical dimples includes dimples having at least two different maximum dimple depths.

In another embodiment, the plurality of dimples includes a plurality of said non-spherical dimples, and the plurality of non-spherical dimples includes dimples having at least two different average edge angles.

In yet another embodiment, the plurality of dimples includes a plurality of said non-spherical dimples, and the plurality of non-spherical dimples includes dimples having at least two different plan shape areas x.

In one embodiment, the plurality of dimples includes a plurality of non-spherical dimples, and the total dimple volume of all said non-spherical dimples is at least 25% of the total dimple volume. In another embodiment, the plurality of dimples includes a plurality of non-spherical dimples, and the total dimple volume of all said non-spherical dimples is at least 50% of the total dimple volume. In yet another embodiment, the plurality of dimples includes a plurality of non-spherical dimples, and the total dimple volume of all said non-spherical dimples is at least 75% of the total dimple volume. In still another embodiment, the plurality of dimples consists of a plurality of said non-spherical dimples.

DETAILED DESCRIPTION

Figure 1A:
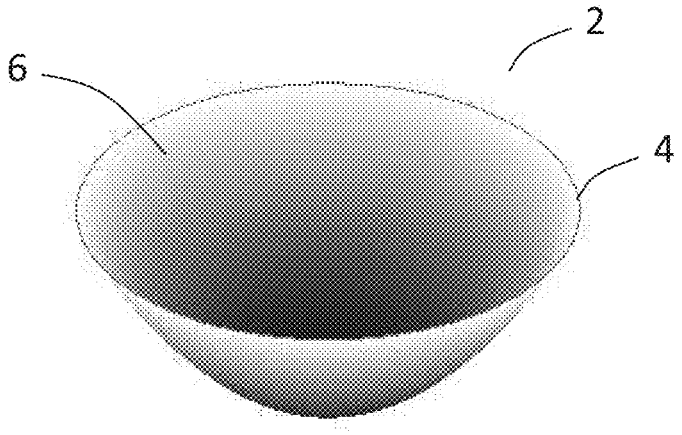
FIG. 1A (Prior Art)
FIG. 1A illustrates a comparative conventional spherical dimple.

Advantageously, golf balls of the invention incorporate improved non-spherical dimples that are uniquely configured to optimize directional flow across the dimple in multiple directions and meanwhile provide added flexibility in both dimple arrangement, count and in creating a visually distinguishable appearance on the golf ball surface due at least in part to the inventive dimple construction and placement thereof within the finished golf ball's outer surface.

In one embodiment, a golf ball of the invention has a generally spherical surface and comprising a plurality of dimples separated by a land area formed on the ball surface, wherein the plurality of dimples includes at least one non-spherical dimple having a non-axially symmetric plan shape and a defined point of maximum dimple depth, wherein: (i) each dimple cross-section of the non-spherical dimple consists of two arcs, each arc extending from the defined point of maximum dimple depth to a point at the land area of the golf ball; and (ii) every point on the perimeter of the non-spherical dimple is located at a radial angle, θ, about a unit circle, where $0 \leq \theta \leq 2\pi$, and the edge angle value of the non-spherical dimple at any given point on the perimeter is defined by the solution of an edge angle function $f(\theta)$, wherein $f(\theta)$ is a non-periodic, continuous, differentiable function definable at all points θ and $0 \leq \theta \leq 2\pi$ and inherently satisfy the condition $f(\theta)=f(2\pi)$. The resulting dimple maintains continual tangency about its surface and has one distinct maximum dimple depth. Continual tangency means the surface will remain smooth with no distinct edges on the dimple surface, and no steps at the dimple edge.

The deepest point on the surface of the dimple is defined as follows. An infinite number of ball radii extend from the centroid of the ball through any point on the dimple surface and through a corresponding point on the phantom surface of the golf ball. The deepest point on the dimple surface is the point where the distance from the centroid to the point on the dimple surface has the minimum value. The maximum dimple depth is the distance from the deepest point on the dimple surface to the phantom surface of the ball along a ball radius.

Furthermore, the term "non-axially symmetric", as used herein, means that the dimple perimeter is not axially symmetric about an axis connecting the centroid of the dimple and the center of the golf ball.

Moreover, herein, the term "non-periodic" means that the edge angle function is non-repeating for $0 \leq \theta \leq 2\pi$.

In one embodiment, each of said non-spherical dimples has a maximum dimple depth of from about 0.005 inches to about 0.020 inches.

In another embodiment, each of said non-spherical dimples has an average edge angle of from about 9 degrees to about 19 degrees. In yet another such embodiment, each of said non-spherical dimples has an average edge angle of from about 10 degrees to about 18 degrees. In still another such embodiment, each of said non-spherical dimples has an average edge angle of from about 12.5 degrees to about 15.5 degrees. In another particular embodiment, the difference between the maximum edge angle and the average of the edge angles of all of the dimple profiles of a single dimple of the present invention is 1.50 degrees or less.

Further, dimples of the present invention have a dimple volume and a plan shape area.

Figure 6:
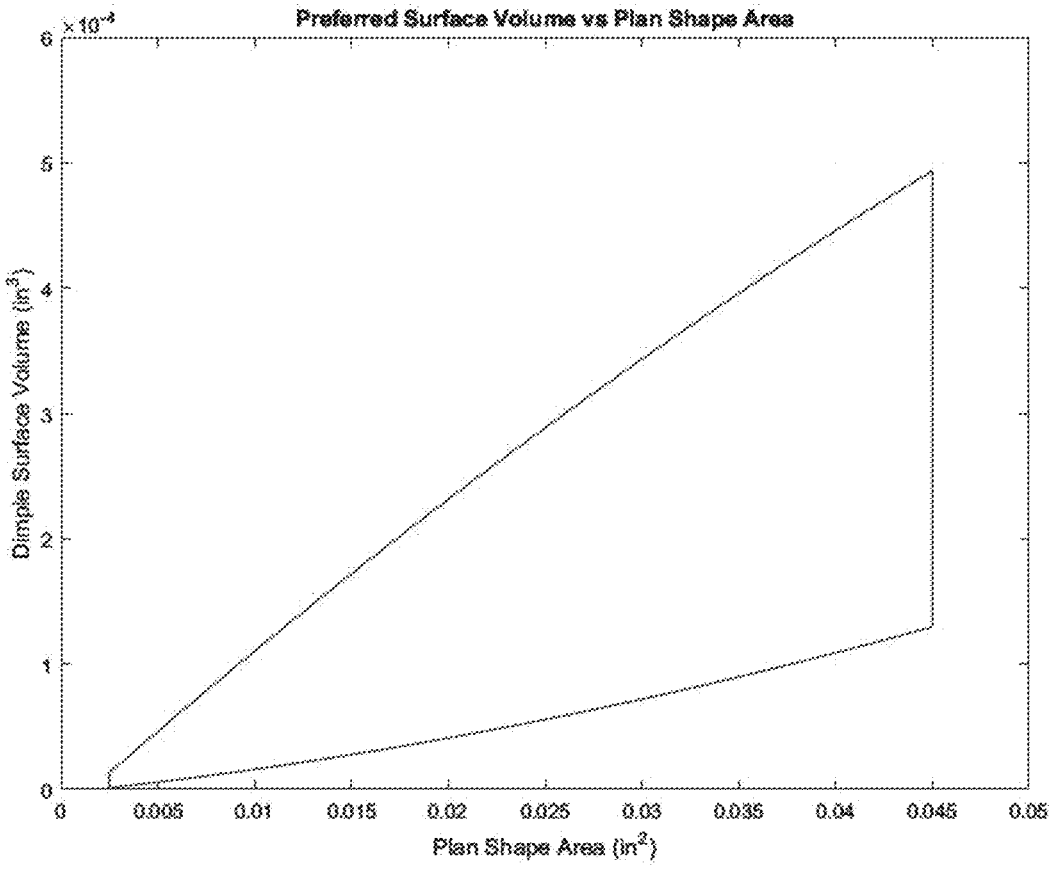
FIG. 6 is a graphical representation illustrating preferred dimple surface volumes for golf balls produced in accordance with the present invention.

By the term "dimple volume," it is meant the total volume encompassed by the dimple surface and the phantom surface of the golf ball. By the term, "plan shape area," it is meant the area based on a planar view of the dimple plan shape, such that the viewing plane is normal to an axis connecting the center of the golf ball to the point of the maximum dimple depth. The plan shape area and total dimple volume should fall within the preferred ranges shown in FIG. 6.

In a specific embodiment, each of said non-spherical dimples has a dimple volume $D_v$ such that $V_s1<D_v<V_s2$; wherein $V_s1=0.0300x^2+0.0016x-3.00\times10^{-6}$, and $V_s2=-0.0464x^2+0.0135x-2.00\times10^{-5}$, and x is the dimple's plan shape area.

In one such specific embodiment, x is from about 0.0025 in.$^2$ to about 0.045 in.$^2$. In another such specific embodiment, x is from about 0.0030 in.$^2$ to about 0.040 in.$^2$. In yet another such specific embodiment, x is from about 0.0025 in.$^2$ to about 0.035 in.$^2$. In still another such specific embodiment, x is greater than 0.0035 in.$^2$ and up to about 0.045 in.$^2$.

In one embodiment, the plurality of dimples includes a plurality of said non-spherical dimples, and the plurality of non-spherical dimples includes dimples having at least two different maximum dimple depths. For purposes of the present disclosure, maximum dimple depths are considered different if their values differ by more than 0.0005 inches.

In another embodiment, the plurality of dimples includes a plurality of said non-spherical dimples, and the plurality of non-spherical dimples includes dimples having at least two different average edge angles. For purposes of the present disclosure, average edge angles are considered different if their values differ by 0.25 degrees or greater.

In yet another embodiment, the plurality of dimples includes a plurality of said non-spherical dimples, and the plurality of non-spherical dimples includes dimples having at least two different plan shape areas. For purposes of the present disclosure, plan shape areas are considered different if their values differ by 7% or more.

In one embodiment, the plurality of dimples includes a plurality of non-spherical dimples, and the total dimple volume of all said non-spherical dimples is at least 25% of the total dimple volume. In another embodiment, the plurality of dimples includes a plurality of non-spherical dimples, and the total dimple volume of all said non-spherical dimples is at least 50% of the total dimple volume. In yet another embodiment, the plurality of dimples includes a plurality of non-spherical dimples, and the total dimple volume of all said non-spherical dimples is at least 75% of the total dimple volume. In still another embodiment, the plurality of dimples consists of a plurality of said non-spherical dimples.

Figure 1B:
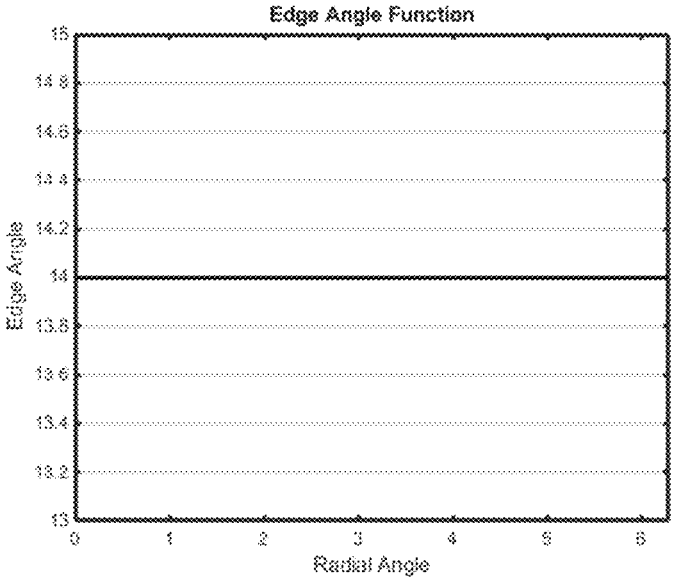
FIG. 1B (Prior Art)
FIG. 1B is graph illustrating the edge angle function for the conventional circular dimple depicted in FIG. 1A in terms of edge angle versus radial angle.
Figure 1C:
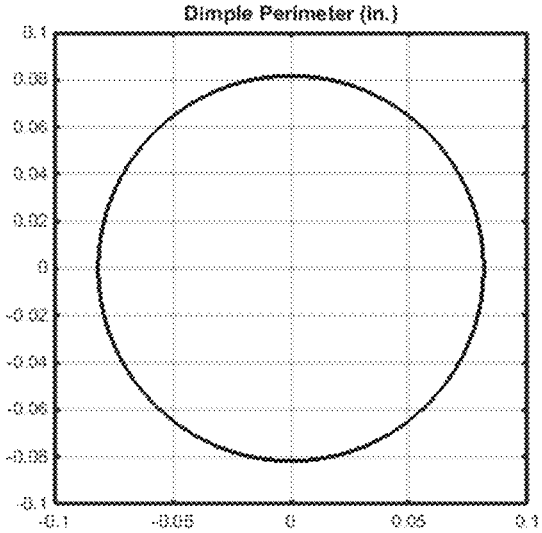
FIG. 1C (Prior Art)
FIG. 1C is a graph depicting the plan shape of the dimple of FIG. 1A.
Figure 2A:
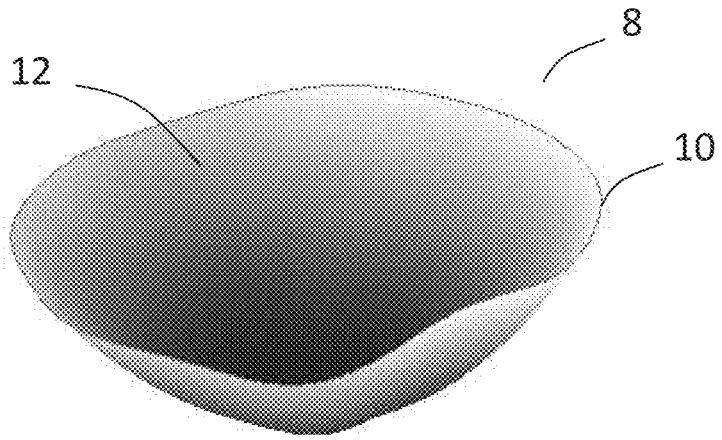
FIG. 2A illustrates an inventive dimple according to one embodiment.
Figure 2B:
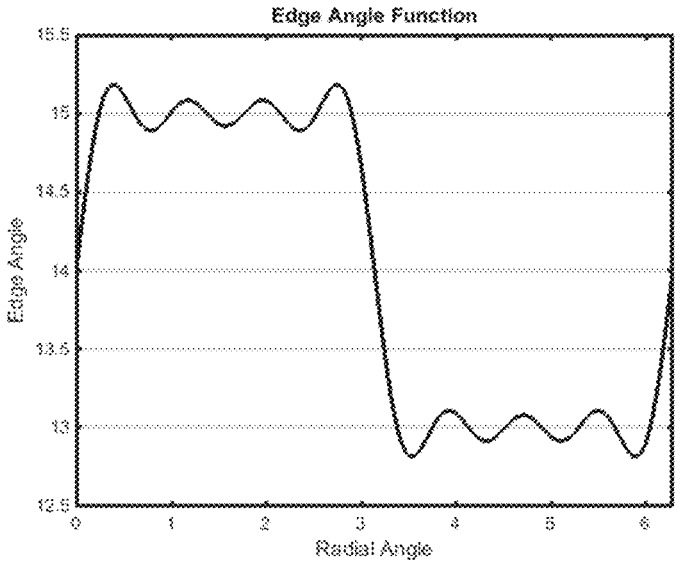
FIG. 2B is graph illustrating the edge angle function for the inventive dimple depicted in FIG. 2A in terms of edge angle versus radial angle.
Figure 2C:
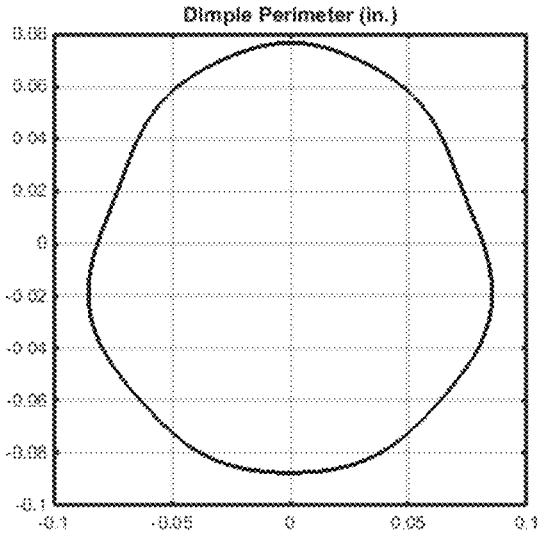
FIG. 2C is a graph depicting the plan shape of the dimple of FIG. 2A.
Figure 3A:
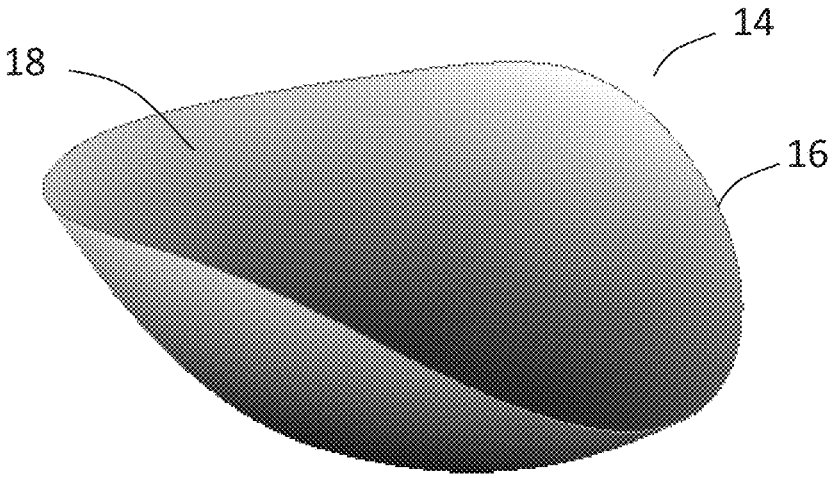
FIG. 3A illustrates an inventive dimple according to another embodiment.
Figure 3B:
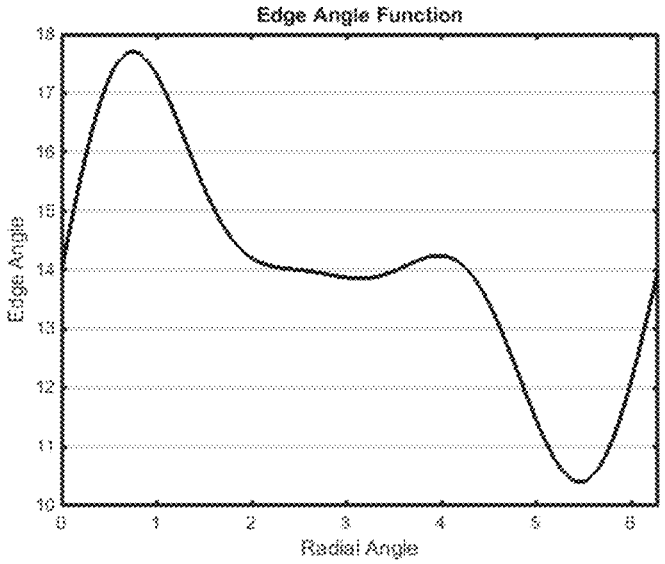
FIG. 3B is graph illustrating the edge angle function for the inventive dimple depicted in FIG. 3A in terms of edge angle versus radial angle.
Figure 3C:
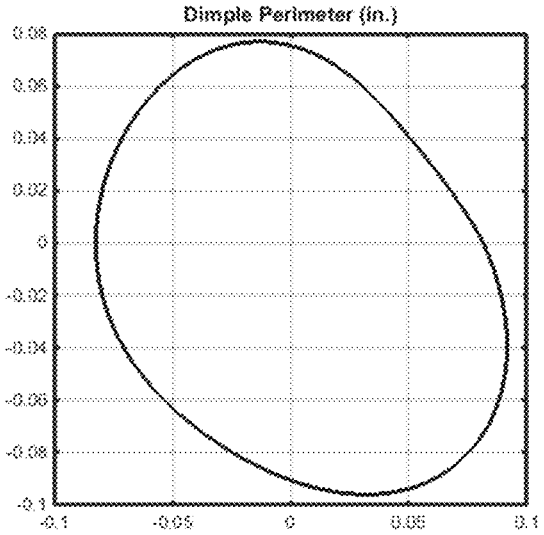
FIG. 3C is a graph depicting the plan shape of the inventive dimple of FIG. 3A.
Figure 4A:
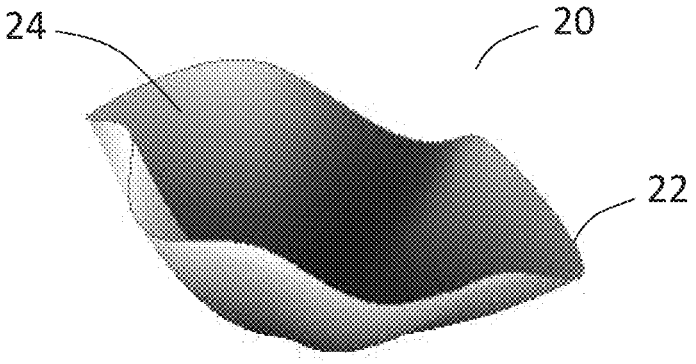
FIG. 4A illustrates an inventive dimple according to yet another embodiment.
Figure 4B:
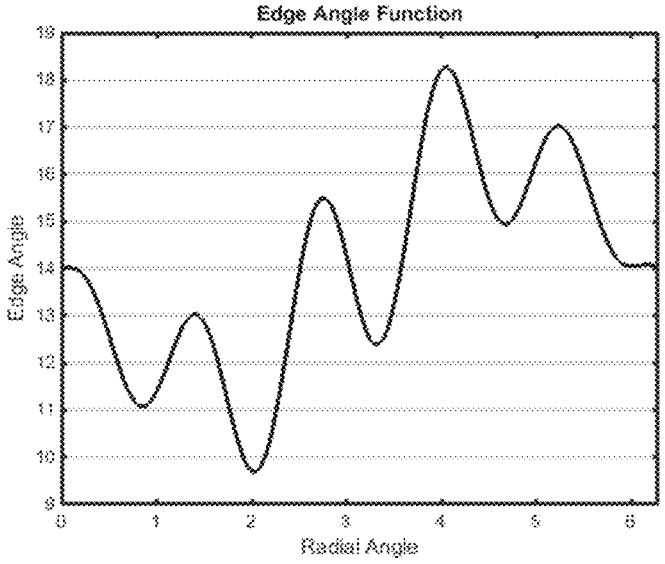
FIG. 4B is graph illustrating the edge angle function for the inventive dimple depicted in FIG. 4A in terms of edge angle versus radial angle.
Figure 4C:
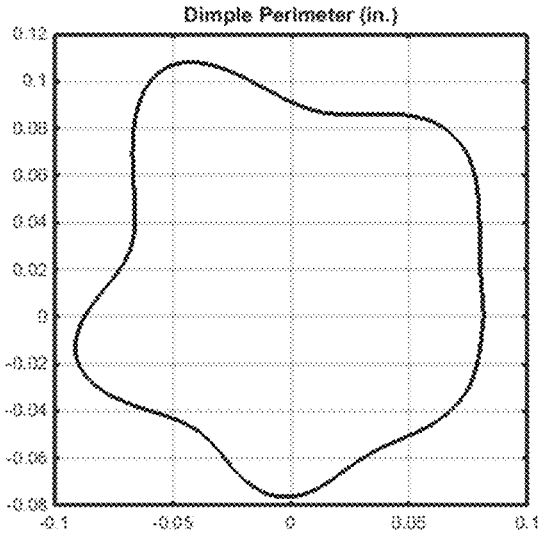
FIG. 4C is a graph depicting the plan shape of the inventive dimple of FIG. 4A.
Figure 5:
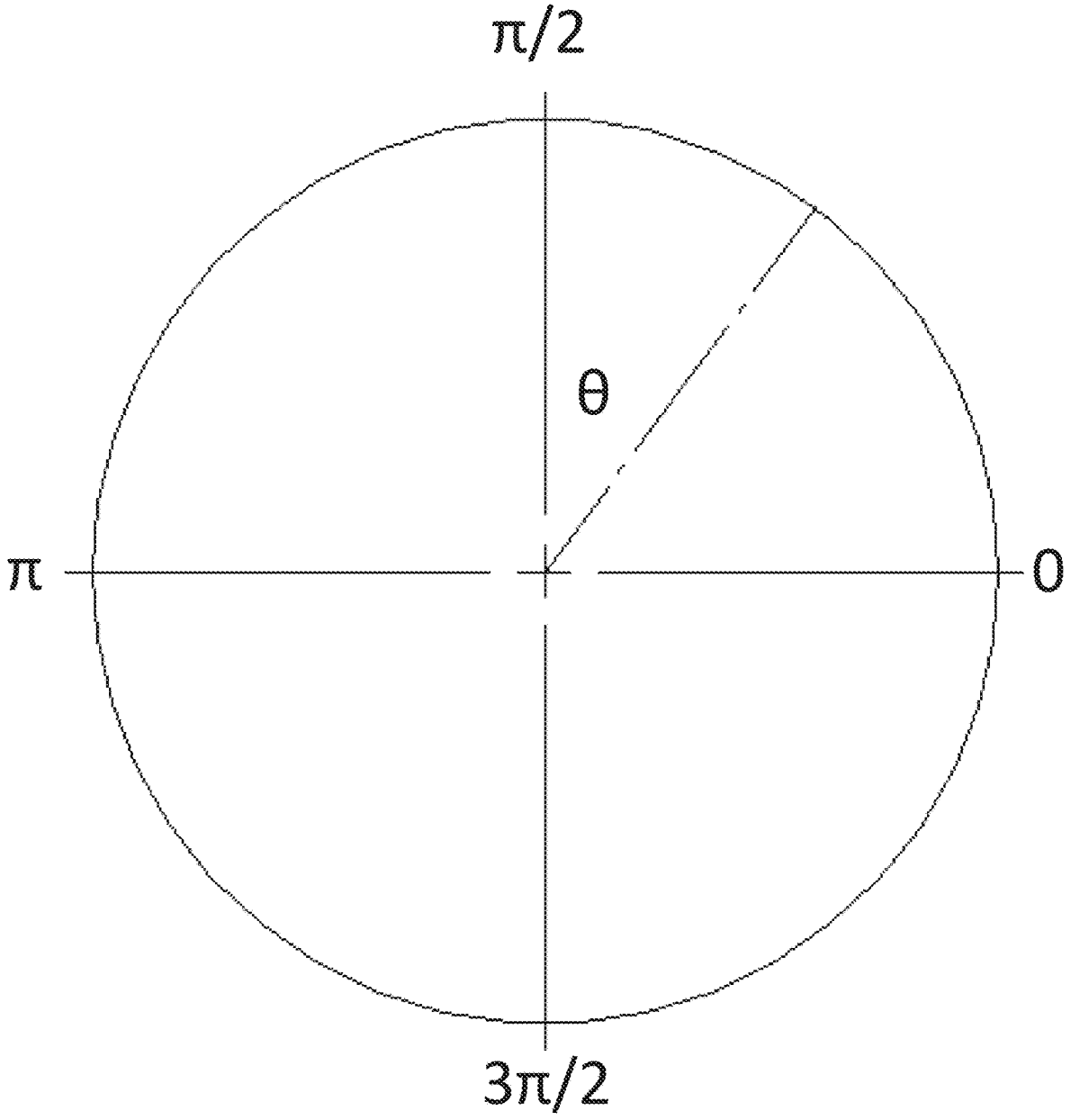
FIG. 5 illustrates angle θ about the unit circle.

FIGS. 2-4 (A-C) illustrate non-limiting examples of resulting inventive non-spherical dimples of golf balls of the invention which may be compared with conventional spherical dimples such as that depicted in FIG. 1(A-C). In this regard, each inventive non-spherical dimple depicted in FIGS. 2A, 3A, and 4A and the conventional spherical dimple depicted in FIG. 1A has an accompanying graph (B), which illustrates the edge angle function for the respective dimple in terms of edge angle versus radial angle, while a corresponding graph (C), illustrates the plan shape of its respective dimple.

Specifically, spherical dimple 2 of FIG. 1A has a conventional perimeter 4 with a circular plan shape and a conventional dimple surface 6 having a single profile shape defined by a spherical function. The edge angle value of spherical dimple 2 is the same at all points on the perimeter, as shown in FIG. 1B.

Figure 8:
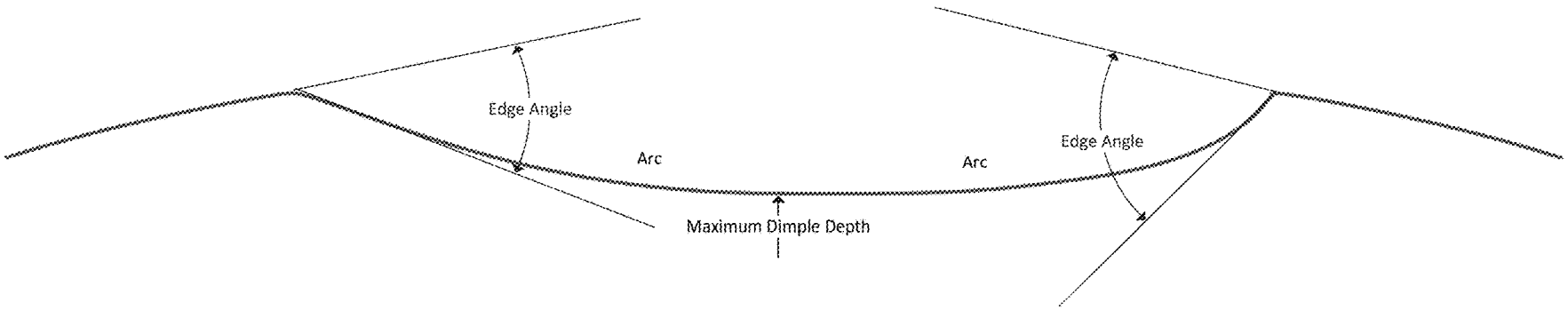
FIG. 8 is a diagram of a profile shape of a dimple having two arcs extending from a defined point of maximum dimple depth to a point at the land area of the golf ball.

In contrast, FIG. 2A depicts an inventive dimple 8 according to one embodiment having perimeter 10 with a non-axially symmetric plan shape and dimple surface 12 having an infinite number of profile shapes each of which consists of two arcs intersecting at the deepest point of the dimple surface. FIG. 8 depicts an example of one such profile shape having two arcs. The edge angle value of the inventive dimple 8 at a given point on the perimeter is determined by the solution to the edge angle function:

$$f(\theta) = 14 + \frac{4}{\pi} \cdot \sin(\theta) + \frac{\sin(3\theta)}{3} + \frac{\sin(5\theta)}{5} + \frac{\sin(7\theta)}{7}$$

which is shown in FIG. 2B.

Furthermore, in FIG. 3A, an inventive dimple 14 according to another embodiment has perimeter 16 and dimple surface 18 wherein the edge angle value of the inventive dimple 14 at a given point on the perimeter is determined by the solution to the edge angle function:

$$f(\theta) = 14 + 5\cos\left(\frac{\theta}{2}\right)^3 \cdot \sin\left(\frac{3}{2}\theta\right) + \frac{\sin\left(\frac{7}{2}\theta\right)}{7}$$

which is shown in FIG. 3B.

Finally, in FIG. 4A, an inventive dimple 20 according to yet another embodiment has perimeter 22 and dimple surface 24 wherein the edge angle value of the inventive dimple 20 at a given point on the perimeter is determined by the solution to the edge angle function:

$$f(\theta) = 14 + \sin(-4.139 \cdot \theta) + \frac{\sin(-1.026 \cdot \theta)}{0.387} + \frac{\sin(5.166 \cdot \theta)}{0.723}$$

which is shown in FIG. 4B.

Accordingly, dimples having a non-circular plan shape are produced that are uniquely configured to optimize directional flow across the dimple in multiple directions and meanwhile provide flexibility in both dimple arrangement, count and in creating a visually distinguishable appearance on the golf ball surface due at least in part to the inventive dimple construction and placement thereof within the finished golf ball's outer surface.

Golf balls of the present invention may further include conventional dimples having any width, depth, depth profile, edge angle, or edge radius and the patterns may include multitudes of dimples having different widths, depths, depth profiles, edge angles, or edge radii.

Since the plan shape of dimple of the present invention is non-circular, the inventive dimples have an effective dimple diameter which is twice the average radial dimension of the set of points defining the plan shape from the plan shape centroid. In one embodiment, dimples according to the present invention have an effective dimple diameter within a range of about 0.005 inches to about 0.300 inches. In another embodiment, the dimples have an effective dimple diameter of about 0.020 inches to about 0.250 inches. In still another embodiment, the dimples have an effective dimple diameter of about 0.100 inches to about 0.225 inches. In yet another embodiment, the dimples have an effective dimple diameter of about 0.125 inches to about 0.200 inches.

Figure 7:
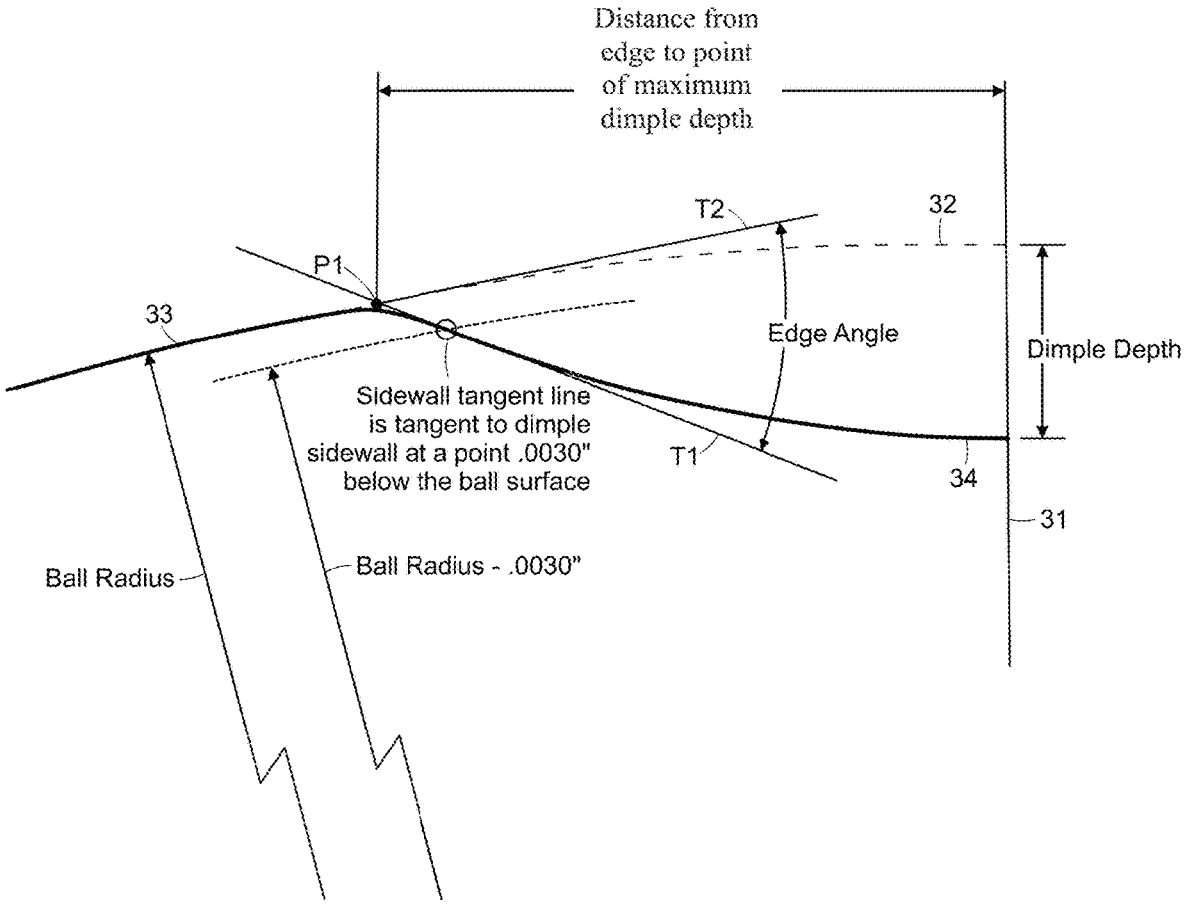
FIG. 7 is a schematic diagram illustrating a method for measuring the edge angle of a dimple of the invention in a golf ball of the invention.

For purposes of the present disclosure, edge angle measurements are determined on finished golf balls. Generally, it may be difficult to measure an edge angle due to the indistinct nature of the boundary dividing the dimple from the ball's undisturbed land surface. Due to the effect of coatings on the golf ball surface and/or the dimple design itself, the junction between the land surface and the dimple is typically not a sharp corner and is therefore indistinct. This can make the measurement of properties such as edge angle and dimple diameter, somewhat ambiguous. To resolve this problem, edge angle on a finished golf ball is measured as follows, in reference to FIG. 7. FIG. 7 shows a portion of a dimple profile 34 extending from the point of maximum dimple depth to the ball's undisturbed land surface 33. Axis 31 is the axis which includes the centroid of the ball and the point of maximum dimple depth. A ball phantom surface 32 is constructed above the dimple as a continuation of the land surface 33. A first tangent line T1 is then constructed at a point on the dimple sidewall that is spaced 0.003 inches radially inward from the phantom surface 32. T1 intersects phantom surface 32 at a point P1, which defines a nominal dimple edge position. A second tangent line T2 is then constructed, tangent to the phantom surface 32, at P1. The edge angle is the angle between T1 and T2. The dimple diameter at this particular dimple cross-section is the distance between P1 and its equivalent point at the opposite end of the dimple profile.

It is envisioned that golf balls of the invention may otherwise have any known construction and include any known number of layers and be comprised of any known polymeric composition(s). Golf balls of the invention may solely include inventive dimples or alternatively further include conventional circular and/or non-circular dimples in order to target desired playing characteristics.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporate herein by reference in their entirety.

What is claimed is:

1. A golf ball having a generally spherical surface and comprising:

a plurality of dimples separated by a land area formed on the ball surface, wherein the plurality of dimples comprises a plurality of non-spherical dimples each having a non-axially symmetric plan shape, a varying edge angle, a defined point of maximum dimple depth, and an effective dimple diameter which is twice an average radial dimension of a set of points defining the plan shape from the plan shape centroid, wherein:

each dimple cross-section of each non-spherical dimple consists of two arcs, each arc extending from the defined point of maximum dimple depth to a point at the land area of the golf ball; and the effective dimple diameter for each of the non-spherical dimples is within a range of about 0.020 inches to about 0.250 inches.

2. The golf ball of claim 1, wherein each of said non-spherical dimples has a maximum dimple depth of from about 0.005 inches to about 0.020 inches.

3. The golf ball of claim 2, wherein each of said non-spherical dimples has an average edge angle of from about 9 degrees to about 19 degrees.

4. The golf ball of claim 2, wherein each of said non-spherical dimples has an average edge angle of from about 10 degrees to about 18 degrees.

5. The golf ball of claim 2, wherein each of said non-spherical dimples has an average edge angle of from about 12.5 degrees to about 15.5 degrees.

6. The golf ball of claim 1, wherein the plurality of non-spherical dimples includes dimples having at least two different maximum dimple depths.

7. The golf ball of claim 1, wherein the plurality of non-spherical dimples includes dimples having at least two different average edge angles.

8. The golf ball of claim 1, wherein the plurality of non-spherical dimples includes dimples having at least two different plan shape areas.

9. The golf ball of claim 1, wherein the total dimple volume of all said non-spherical dimples is at least 25% of the total dimple volume.

10. The golf ball of claim 9, wherein the total dimple volume of all said non-spherical dimples is at least 50% of the total dimple volume.

11. The golf ball of claim 10, wherein the total dimple volume of all said non-spherical dimples is at least 75% of the total dimple volume.

12. The golf ball of claim 1, wherein every point on the perimeter of the non-spherical dimple is located at a radial angle, $\theta$, about a unit circle, where $0 \leq \theta \leq 2\pi$, and the edge angle value of the non-spherical dimple at any given point on the perimeter is defined by the solution of an edge angle function $f(\theta)$, wherein $f(\theta)$ is a non-periodic function.

13. The golf ball of claim 1, wherein the dimples have an effective dimple diameter of about 0.100 inches to about 0.225 inches.

14. The golf ball of claim 13, wherein the dimples have an effective dimple diameter of about 0.125 inches to about 0.200 inches.

15. A golf ball having a generally spherical surface and comprising:

a plurality of dimples separated by a land area formed on the ball surface, wherein the plurality of dimples comprises a plurality of non-spherical dimples each having a non-axially symmetric plan shape, a varying edge angle, and a defined point of maximum dimple depth, wherein:

each dimple cross-section of each non-spherical dimple consists of two arcs, each arc extending from the defined point of maximum dimple depth to a point at the land area of the golf ball; and each of said non-spherical dimples has a dimple volume $D_v$ such that $V_s1 < D_v < V_s2$; wherein $V_s1 = 0.0300x^2 + 0.0016x - 3.00 \times 10^{-6}$, and $V_s2 = -0.0464x^2 + 0.0135x - 2.00 \times 10^{-5}$, and x is the dimple's plan shape area.

16. The golf ball of claim 15, wherein x is from about 0.0025 $in^2$ to about 0.045 $in.^2$.

17. The golf ball of claim 16, wherein x is from about 0.0030 $in^2$ to about 0.040 $in.^2$.

18. The golf ball of claim 17, wherein x is from about 0.0025 $in^2$ to about 0.035 $in^2$.

19. The golf ball of claim 18, wherein x is from about 0.0035 $in^2$ to about 0.045 $in.^2$.

20. A golf ball having a generally spherical surface and comprising:

a plurality of dimples separated by a land area formed on the ball surface, wherein the plurality of dimples comprises a plurality of non-spherical dimples each having a non-axially symmetric plan shape, a varying edge angle, a defined point of maximum dimple depth, and an effective dimple diameter which is twice an average radial dimension of a set of points defining the plan shape from the plan shape centroid, wherein:

each dimple cross-section of the non-spherical dimples consists of two arcs, each arc extending from the defined point of maximum dimple depth to a point at the land area of the golf ball; and the plurality of non-spherical dimples comprise at least one dimple in which every point on the perimeter of the dimple is located at a radial angle, $\theta$, about a unit circle, where $0 \leq \theta \leq 2\pi$, and the edge angle value of the dimple at any given point on the perimeter is defined by the solution of an edge angle function $f(\theta)$, wherein $f(\theta)$ is one of the following:

$$1.\ f(\theta) = 14 + \frac{4}{\pi} \cdot \sin(\theta) + \frac{\sin(3\theta)}{3} + \frac{\sin(5\theta)}{5} + \frac{\sin(7\theta)}{7}$$

-continued

2. $f(\theta) = 14 + 5\cos\left(\frac{\theta}{2}\right)^3 \cdot \sin\left(\frac{3}{2}\theta\right) + \frac{\sin\left(\frac{7}{2}\theta\right)}{7}$ 3. $f(\theta) = 14 + \sin(-4.139 \cdot \theta) + \frac{\sin(-1.026 \cdot \theta)}{0.387} + \frac{\sin(5.166 \cdot \theta)}{0.723}$.

* * * * *